United States Patent [19]

Figdor et al.

[11] Patent Number: 4,850,952

[45] Date of Patent: Jul. 25, 1989

[54] METHOD AND DEVICE FOR THE SEPARATION AND ISOLATION OF BLOOD OR BONE MARROW COMPONENTS

[76] Inventors: Carl G. Figdor; Willy S. Bont, both of The Netherlands Cancer Inst. Plesmanlaan 121, 1066 CX Amsterdam, Netherlands

[21] Appl. No.: 50,768

[22] PCT Filed: Jan. 13, 1986

[86] PCT No.: PCT/NL86/00002

§ 371 Date: Jun. 26, 1987

§ 102(e) Date: Jun. 26, 1987

[87] PCT Pub. No.: WO87/01307

PCT Pub. Date: Mar. 12, 1987

[51] Int. Cl.[4] ..... B04B 11/00

[52] U.S. Cl. ..... 494/37; 137/613; 494/45

[58] Field of Search ..... 494/37, 18, 35, 45, 494/31, 32, 33, 16, 21; 422/72; 210/781, 782; 137/613; 251/7, 8

[56] References Cited

U.S. PATENT DOCUMENTS

| | | | |
|---|---|---|---|
| 2,616,619 | 11/1952 | Leod | 494/37 |
| 3,489,145 | 1/1970 | Judson . | |
| 3,519,201 | 7/1970 | Eisel . | |
| 3,679,367 | 7/1972 | Negersmith . | |
| 3,724,747 | 4/1973 | Unger . | |
| 4,098,456 | 7/1978 | Bayham | 494/16 |
| 4,337,791 | 7/1982 | Tech | 251/8 |
| 4,405,079 | 9/1983 | Schoendorfer . | |
| 4,413,773 | 11/1983 | Rohde | 494/37 |
| 4,419,089 | 12/1983 | Kolobow . | |
| 4,456,030 | 6/1984 | Bogossian | 251/8 |
| 4,482,342 | 11/1984 | Lueptow | 494/37 |
| 4,531,932 | 7/1985 | Luppi . | |

FOREIGN PATENT DOCUMENTS

| | | |
|---|---|---|
| 0026417 | 4/1981 | European Pat. Off. . |
| WO81/03626 | 12/1981 | PCT Int'l Appl. . |

OTHER PUBLICATIONS

Nature, vol. 217, Mar. 2, 1968, Judson et al., "Closed Continuous Flow Centrifuge", pp. 816–818.

*Primary Examiner*—Robert W. Jenkins
*Attorney, Agent, or Firm*—Lahive & Cockfield

[57] ABSTRACT

After separation and during centrifuging a separated blood component is transferred from a source reservoir (2) into a tube (4) oriented against a centrifugal gradient. A cap (34) converts the separated layer from the reservoir into a columnar body and the centrifugal gradient prevents mixing of the columnar body in the tube (4) during further centrifuging. In one embodiment the tube has a volume sufficient to hold a desired fractional component from the source reservoir, and a diameter small enough to prevent mixing of the component when the gradient is removed. A support (69) holds the conduit wound about a spool transverse to the iso-g-lines of the centrifuge. The support (69) may be removably affixed to the cap (34). In a preferred embodiment the source reservoir (2) has a flexible wall, and pressure of the wall against an elevation (29) maintains pressure in the fluid system. Flow blocking (7) and flow regulating means are shown for delivering small fractional components to the tube or to receiving reservoir at a desired rate. In another embodiment a make-up fluid reservoir maintains fluid pressure and a peristaltic pump controls the transfer of separated components. A table with movable clamps (65–67) is also shown for isolating the fractions in the tube after centrifuging.

50 Claims, 5 Drawing Sheets

METHOD AND DEVICE FOR THE SEPARATION AND ISOLATION OF BLOOD OR BONE MARROW COMPONENTS

BACKGROUND OF THE INVENTION

The invention concerns a method and device for the separation of blood or cells of blood-forming organs, such as bone marrow, into their components and for the isolation of those components by means of centrifuging in which a source reservoir, which is connected with one or more recipient reservoirs via an outflow opening, is applied as a container for the blood or the bone marrow.

Blood consists of four components which, in order of increasing specific gravity, are: blood plasma, blood platelets, white blood cells and red blood cells. For the red blood cells further distinction is made between the old cells—the gerocytes and the newly-formed cells—the neocytes. The average lifetime of a red blood cell is approximately 90 days. "New" cells will therefore still be able to live for a relatively long time, which can be of great importance in the case of blood transfusion. The specific gravity of the red blood cells increases as they get older, so that with the aid of centrifuging it is possible to achieve a certain distribution of the red blood cells according to age. White blood cells and blood platelets— together called 'buffycoat'—constitute in total approximately 1% of the volume of normal blood. Approximately 45% of the total volume is taken up by red blood cells and after centrifuging approximately 50% of the neocytes are situated in a layer thereof, which layer comprises approximately 10% of the total outgoing volume.

In the prior art, both the components which constitute the buffy-coat and the neocytes are separated from one another according to a known procedure, and thereafter isolated from one another. For this purpose see, for example, European Pat. No. 0026417. A difficulty in this connection is the isolation of the relatively small fractions—the white cells, the platelets and the neocytes—without much loss occurring through, for example, contamination in the adjoining surfaces.

In European Pat. No. 0026417 a method is described for the separation and isolation of blood components. After separation by centrifuging the layers are successively pumped out of the source reservoir and then collected. The pumping out is done by exerting a sideways pressure on the flexible source reservoir with the aid of a pressure cushion. Liquid is then pressed out of the reservoir. A description is given of how in that way blood plasma is transferred to an adjacent recipient reservoir.

A device for separating and isolating blood components described in the above-discussed European Pat. No. 0026417 consists of a centrifuge with one or more containers mounted at a certain radial distance from the centrifugal axle which rotate together with the centrifuge during use. Each contains a source reservoir with an outflow opening which is in the main directed at the centrifugal axle, with which the reservoir is joined via an outflow pipe with one (or more) recipient reservoir(s) as a closed system. This centrifuge is equipped with a pump mechanism with which, after they have been separated, the components are pumped out of the source reservoir to the recipient reservoir(s).

In "Nature", vol. 217, page 816 et seq., a method is described with which the said disadvantage is removed, with the aid of a "continuous-flow" process. Thereby the components are both separated and isolated during centrifuging. Contamination after centrifuging does therefore not occur there.

This described process, however, also has disadvantages: the necessary supply and drain pipes with their accompanying channels and rotating seals lead to a costly and complex construction. Another disadvantage is that in one centrifugal process there can only be worked with one reservoir, which leads to a low processing capacity.

SUMMARY OF THE INVENTION

According to one aspect of the invention, methods and apparatus are disclosed in which a source reservoir is centrifuged and fractional components thereof are pumped out into a co-rotating receiving reservoir during centrifuging.

This method according to the invention makes the pumping out of components during centrifuging possible in a simple way without the said disadvantages occurring, and has for that purpose the characteristic that after a certain centrifuging time, pumping takes place during centrifuging with the aid of a pump mechanism which rotates with the centrifuge, and that the entire liquid system: the recipient reservoir(s), the source reservoir and the joining pipe(s) rotate together, whilst the centrifuge is kept in balance.

Because of the fact that the pump rotates together with the centrifuge, the costly pipes and rotating seals have become unnecessary.

Imbalance of the centrifuge can be avoided by either situating the recipient reservoir(s) at approximately the same place with relation to the centrifuge axis as the source reservoir, or by ensuring in another way, for example via a separate—also co-rotating—liquid system, such that in the place of the source reservoir the weight of liquid which flows out of it is compensated.

When a high rotational speed of the centrifuge is necessary for obtaining and maintaining a well defined separation surface between the layers during pumping, the difficulty arises with this method that a vacuum can be formed in the joining pipe between the source and the recipient reservoir, due to which further pumping out of the components may be impeded.

This difficulty can, according to a further characteristic of the method according to the invention, be overcome by ensuring that during centrifuging the liquid in the system is subjected to an extra pressure.

Such a pressure is obtained according to one way of implementing the method by introducing extra liquid into a system of flexible reservoirs which can only expand to a limited degree. The limitation of the expansion can be effected for example if both reservoirs are situated in a closed container. When extra liquid is then brought into the system the reservoirs will expand with their flexible walls and fill the container completely, after which the desired extra pressure in the system occurs with only a small excess of liquid. Plastic disposable reservoirs, for example, could be used as reservoirs. The extra fluid can, for example, be introduced into the system from an extra reservoir which is in fluid pressure communication via a delivery pipe with the recipient reservoir, and which, in relation to the expansion possibilities of the system, is filled with sufficient liquid, and from whereout, if a vacuum occurs in the system, liquid can be drawn into the system.

Such an extra pressure can also be created by externally increasing the pressure on the system, or on part of it. Of course, in order to obtain the desired effect, it is necessary that at least a part of the system, for example a reservoir, has a flexible wall, from where the extra pressure to the system can be given.

The said methods are especially applied when separating blood into its components and when separating bone marrow cells.

The said components of blood are: blood plasma, red blood cells, blood platelets and white blood cells, with specific gravities of 1.03; 1.10; 1.05 and 1.07 g/ml. The white blood cells can be divided again into mononuclears and granulocytes. The demand for the different components with a high purity is high. In order to avoid undesired immunological reactions with patients as a result of transfusion and transplantations, one desires namely to administer a patient with only those components which are necessary. As only approximately one percent volume of blood exists of blood platelets and white blood cells together, and the blood platelets, the mononuclear white cells and the granulocytes must each be isolated out of this mixture, a method according to which contamination of a component with cells of another component is avoided to a great degree is difficult to achieve, whilst the need therefore is nevertheless great.

Besides the greater purity of the isolated components the advantages of the methods according to the invention are that the yield, or quantity of the component which can be extracted out of a certain quantity of the source mixture is considerably higher than according to the known methods, and that more units can be processed at the same time in a centrifuge with more source reservoirs, as a result of which more blood can be separated per unit of time.

When separating and isolating blood components it appears to be important, in order not to disturb the dividing surfaces during pumping between the layer containing the blood platelets and the white blood cells on the one hand, and the layers containing the blood plasma and the red blood cells on the other hand, to centrifuge at a high rotational speed; for example with a centrifuge with an arm length of 26 cm, at more than 500 revolutions per minute (rpm). At approximately 800 rpm the problem of the vacuum in the joining pipe began to occur and it was necessary to increase the pressure in the system. At 2000 rpm the necessary extra pressure appeared to be 6 atm., which was achieved by introducing more liquid—a physiological salt solution—into the system.

The invention also includes a device for the execution of the method according to the invention. This device consists of a centrifuge with one or more containers at a certain radial distance to the centrifuge axis which rotate in use together with the centrifuge, and which each either serve as a source reservoir, or contain a source reservoir, whereby the source reservoir has an outflow opening which at least in the main is directed radially and which is joined as a closed fluid system with a recipient reservoir by a tube which is in the main radially directed, and with a co-rotating pumping mechanism for pumping liquid out of the source reservoir to the recipient reservoir(s).

The containers are each situated for example at the end of an arm which extends radially from the rotation axis. From the source reservoir runs a tube, in which a flow of the liquid to the recipient reservoir(s) is brought about by the co-rotating pump mechanism.

In order to ensure that the centrifuge remains in balance during pumping one must ensure that the mass at the end of the arm of the centrifuge always remains the same. For this purpose liquid is continually introduced into a container during pumping.

A suitable solution is obtained with a device of which the pump mechanism consists of a second co-rotating liquid system (II) with a flexible recipient reservoir which fills a container together with the, also flexible, source reservoir of the first liquid system (I), and which contains a liquid in its source reservoir which is situated outside the container with a density which is just a little larger than that of the liquid which must be centrifuged. When this heavier liquid is pressed into the container by the centrifugal force in the recipient reservoir (II), because of the fact that the reservoirs are closed in, an equal amount of fluid is pressed out of the source reservoir (I) of the first system. The total mass at the end of an arm thus remains approximately constant.

The two systems indicated here with I and II are joined together in such a way that source reservoir (I) and recipient reservoir (II) and situated in one container and source reservoir (II) and recipient reservoir (I) are situated in another container.

A co-rotating pump can in principle be situated anywhere in the centrifuge, for example also in the container of the reservoirs. Thus a conical shaped "cap", which is movable in a radial direction and which rests on the the source reservoir, can serve as a "pump", if the specific gravity of that cap lies between that of the two components which are to be separated. The recipient reservoir then lies against the radially inward side of the cap. As a component flows out the source reservoir into the recipient reservoir, the cap is pushed outwards in a radial direction and it will function as a pump.

A simple solution for the balancing problem is achieved if, in the device according to the invention, a container contains both the source reservoir and the corresponding recipient reservoir(s). The total quantity of liquid in the container does not then change.

For centrifuging at a high rotational speed, in order to avoid the forming of a vacuum in the system, a device according to the invention is equipped with a source reservoir and recipient reservoir(s), both with flexible walls, which are situated in a container which contains them completely and which they approximately fill when in use, whereby an extra reservoir, which is filled with a liquid when in use, is coupled in fluid pressure communication with the system with an open join in the section between the container and the centrifuge axle.

The make-up fluid in the reservoir which is preferably a saline solution having a density greater than the various components of the fluid mixture, may be adapted to flow into the source reservoir for displacing the lighter separated components therefrom, or may be adapted to flow into a separate pressure vessel or balloon which contacts the source reservoir and applies pressure thereto to express the separated components thereof.

Various designs can be chosen as pump mechanisms. According to one preferred design the device contains a usual type of peristaltic pump, which rotates together with the centrifuge, and whose drive shaft is situated in the extension of the rotating shaft of the centrifuge, mechanically coupled to it, e.g., by a clutch, which coupling can be disconnected during centrifuging. The coupling with the centrifuge shaft is for example via the pump housing. The clutch can be disconnected by disengaging the drive shaft during centrifuging with the aid of a pressure plate which is fixed at a stationary point, for example the lid of the centrifuge. The pump housing will then rotate around its now stationary drive shaft and the pump will therefore pump.

Other designs of the pump mechanism are also possible. For example the pump mechanism can be a barrel (II) on or near the centrifuge shaft which rotates together with the centrifuge, and which is filled with a liquid with a larger density than that of the heaviest component of the mixture which is to be separated. This barrel is joined via a pipe with a flexible recipient reservoir (II), discussed above, which is situated together with the flexible source reservoir (I) of the mixture in a closed container at the end of the centrifuge arm. During centrifuging this liquid will then flow to the recipient reservoir (I) in this container. As this reservoir is filled, the source reservoir (I) is compressed and liquid will be pushed out of it to a recipient reservoir (I) on or near the centrifuge shaft. In order to avoid the centrifuge getting out of balance a liquid must be chosen as pumping liquid with a density which is just a little larger than that of the heaviest component of the mixture.

Different mechanical elements and configurations are employed in several aspects of the invention to control the rate of pumping during centrifuging, so as to isolate precise components of the fluid being treated.

A method according to the invention aims firstly at being able to "treat" as much blood as possible in one centrifugal processing run, with as large a quantity as possible per quantity of blood of each component of a certain high purity, and secondly at keeping the duration of one centrifugal processing run as short as possible. In order to achieve the first thing it is important, among other things, that an optimum use is made of the space which a centrifuge offers for the placement of source reservoirs.

One method according to the invention is based on the insight, that is is possible to achieve a pump mechanism which does not take up any space in the sense mentioned. This method has for that purpose the characteristic that the pumping-out is effected by reducing the volume of the source reservoir by pressing in the radially outer wall of this reservoir. This can be achieved in two ways. The first means of achieving this according to the invention is that the pressing-in is effected by allowing the source reservoir to move radially outward under influence of the centrifugal force, with its outer wall against an elevation in the floor of the container, and the second means of achieving it is that the pressing-in is effected by moving an elevation in the floor of the container radially inward, and pressing-into the outside wall of the source reservoir.

In order to further achieve a shortest possible duration of one centrifugal processing run it is important that pumping out is always done at as high a speed as possible. As the buffy-coat layer is a relatively thin layer, there is an upper limit to the speed at which it can be pumped out. Once the upper limit is exceeded the buffy coat layer will, on reaching the outflow opening, be "broken" and red blood cells will also be pumped out together with the buffy coat.

In order to achieve an optimum pumping-out process as far as duration is concerned the method according to the invention has a further characteristic that the speed with which the reservoir is pressed-in is relatively high when pumping out a relatively voluminous component, and relatively low when pumping out a component which is of relatively little voluminousness.

For the execution of the method according to the invention such a device has the characteristic that the side walls of the source reservoir converge in an approximately funnel-like shape to the outflow opening and that a mechanism is present to reduce the volume of the reservoir from the radially outer side of the reservoir with an adjustable speed. The funnel shape at the radially inner end serves to be able to efficiently isolate the components. If only a small amount of a layer has remained behind in the reservoir, the funnel shape ensures that as the layer approaches the outlet it becomes so thick, that it can be pumped out without being mixed with a following layer. This is especially true for the buffy-coat layer, which has but a very small thickness in total.

The mechanism to adjust the speed with which the reservoir is compressed serves to obtain an optimum speed, that is to say to adjust the rate of outflow from the reservoir for each layer according to the layer thickness.

The funnel shape can be effected by constructing the radially inner end of the otherwise flexible reservoir of a stiff material. In a preferred design of the device according to the invention there is a funnel shaped stiff cap fitted over the inner end of the reservoir. The cap has an opening, and its jacket is open from its outer to its inner end over a width which is at least equal to the diameter of the inflow pipe. The opening in the jacket serves to enable the cap to be placed on the reservoir together with its permanently joined outflow pipe. Such a cap is preferably conical.

A design of a device according to the invention, suitable for the method in which the source reservoir moves radially outwards, has the characteristic that the outside wall of the container has an elevation on its inside side which when at rest lies against the radially outside wall of the source reservoir, which is situated in a mainly cartridge-shaped housing containing the side walls of the reservoir, which is movable by sliding in a radial direction along the inside of the side walls of the container. The cartridge around the reservoir serves to make it possible that the reservoir can move in the container. Housing and cap are preferably joined to one another, for example by means of a screw closure.

In order to make better use of the space which a centrifuge has to offer to reservoirs for the blood which is to be separated, the walls of the housing converge, according to the a further preferred design of the device, radially from the outside to the inside, while the side walls of the container also converge towards the inside approximately parallel to those of the housing, and a wall or part of a wall of the container is removable over a width corresponding to the width or the diameter of the source reservoir. Such containers can be arranged as sectors of a flat disk, with the centrifuge shaft at its center.

In order to create room for the recipient reservoirs, the containers of the source reservoirs are preferably executed in a conical shape. The recipient reservoir(s) can then be placed per source reservoir on the outer wall of the cone.

In a construction with a converging housing in a converging container the housing must be guided when it moves in a radial direction. In a design of a device this happens by supporting devices, which consist of a radially directed rod which is fixed at one end to the inward portion of the container, and at the other end is joined in a sliding manner to the inside end of the housing and to guiding surfaces on the back inside face of the outer circumference of the container which extend approximately radially inwards, with a distance between them corresponding to the distance between the housing walls at the outer side of the housing and running inward to at least above the elevation.

In order to regulate the rate at which fluid is pumped, and thus the rate at which the outside wall of the source reservoir is compressed, a design of the mechanism which serves for that purpose is characterized by the fact that the outside face of the reservoir extends over the adjoining surface of the elevation in a ring shaped part, and that under this part and around the elevation two or more inflatable rings are situated, lying over each other as viewed in a radial direction, and equipped with valves with independently regulatable flow openings. This design makes two pump speeds possible. When the first layer—the plasma—is pumped out the speed can be high. The valve in the first air-filled ring can be adjusted in such a way that the outflow is high, whilst the other valve is closed. When the buffy-coat has advanced to the outflow opening the speed must be reduced. At that moment, the valve which until then was open must be closed and the other, narrower, valve is opened. The result is a lower pumping rate.

Opening and closing of the valves can for example be controlled electronically with the aid of sensors.

If, instead of using the centrifugal force which moves the source reservoir radially outward, use is made of a body which presses into the outer face of the reservoir from outside, the outside wall for example is equipped with an opening, through which an elevation, of which the inner face coincides with the outer side of the container when at rest, can be moved inwards in a radial direction.

Especially when separating, isolating and keeping isolated components which together form the relatively small buffy-coat fraction, problems arise. These components of the buffy coat are the white blood cells and the blood platelets. This is also valid for the thin topmost or lightest layer of the red blood cells: the neocytes. In order to achieve a good separation in the recipient reservoir and to ensure that isolation is possible after separation without contamination occurring, special demands must be made of the recipient reservoir. These demands are fulfilled in a design of the device according to the invention which has the characteristic for that purpose that a recipient reservoir consists of a tube which is connected to the outflow opening and which opens up with its other end into a chamber, whereby the contents of the tube are at least equal to the volume of the platelets, white cells and possibly neocytes which are present in the blood or bone marrow, whilst the diameter is at largest so large, that after separation and when at rest, no mixing of the components occurs and that provisions are available at the radially inward portion of the source reservoir for placing the tube in such a manner that during centrifuging the g-value in the tube decreases along the length of the tube.

In particular it is desired to support the tube in such an orientation that a sufficient centrifugal gradient is developed along the tube to maintain a separation between the different fractional blood components therein.

In the chamber the plasma is collected first. After that the buffy coat, arrived at the radially inward end of the source reservoir and divided into both its components, is pumped into the tube, which can contain both components and if desired also the neocytes. These two or three components are then situated one outside the other in the tube. In order to ensure that the separation remains intact it is necessary that the centrifugal force value in the tube continually decreases in the direction of the inflow into that tube. This means in practice that if the tube is stored in one way or another, for example rolled onto a reel, this must be done in a manner adapted for that purpose. Such a reel is then situated radially inward from the outflow opening and is preferably mounted on the stiff cap over the inner end of the source reservoir.

In order to easily collect the components which successively fill the tube, it is advantageous to have connected the tube to a closable accessory chamber in a zone of the tube where a particular component is situated. By opening the entrance to that chamber the relevant component can flow into the chamber, after which the chamber is closed again.

A purpose of the invention is to be able to isolate in an efficient manner especially also the said components which are present in relatively small quantities after they have been separated in the source reservoir. The device according to the invention is for that purpose characterized in that the outflow pipe is a flexible tube with a capacity which is at least equal to the total volume of the white blood cells, blood platelets and possibly neocytes which are present in the source reservoir, and in that the device is equipped with such facilities for storing the tube that during centrifuging the centrifugal force in the tube continually decreases from the outside to the inside seen in the direction of the centrifuge arm.

The tube forms the connection between the source reservoir and the recipient reservoir(s). When, after separation of the components in the source reservoir, the liquid is pumped out in one way or another via an opening in that reservoir, directed towards the centrifuge shaft, the relatively light blood plasma will come into the tube first and from there into the recipient reservoir. After that, the buffy-coat layer will flow into the tube with the platelets at the inside, followed by the white cells—and outside of them the neocytes or at least the neocyte-rich red blood cells will follow.

To achieve that the centrifugal force in the tube continually decreases, during centrifuging, in the direction of flow, the tube can, in one design of the device according to the invention, be wound on a reel, whose axis is perpendicular to the centrifuge shaft and whose cross section perpendicular to the axis is circular, whilst the adjacent windings of the tube continually form a positive angle with the iso-g-lines, whose the size of the angle varies with the thickness of the tube, the diameter of the reel and the distance to the centrifugal axis.

By iso-g-lines is understood: closed lines with equal centrifugal force value around the surface of the reel. These lines are not the same as the circle-shaped cross sections of the reel.

An iso-g-surface is the surface of a cylinder having the centrifuge shaft as its central axis. An iso-g-line is the intersection of such a surface with the reel surface, and is thus a curved line about the reel of equal radial distance from the axis of the centrifuge. As such, an iso-g-line on the reel follows a roughly saddle-shaped contour about the reel. When the tube is wound about the reel spool-like, so as to always make a positive angle with the iso-g lines, a centrifugal gradient will operate on the contents of the tube to inhibit the mixing of components, which might otherwise occur.

In one embodiment, the windings of the tube lie, seen in the direction of the axis of the reel, next to one another, due to the fact that the increase in thickness of an edge flange, over one turn in the direction of winding, is equal to the thickness of the tube.

For a good functioning of the device according to the invention the dimensions given to the tube, in which the components which are to be isolated after being pumped out of the source reservoir are situated, are of great importance.

If the device according to the invention is used for the separation and isolation of white blood cells and platelets out of blood, a preferred design of such a device is characterized in that the volume of the tube is equal to at least 1% of the volume of the blood in the source reservoir, and in that the inner diameter of the tube is equal to 5 mm at the most.

If the diameter of the tube is larger than 5 mm it appears that after the centrifuging process has ceased a relatively substantial contamination by mixing occurs in the adjoining surfaces of both separated components.

If the device according to the invention is used not only for the separation and isolation of white cells and platelets out of blood but also of neocytes, the volume of the tube must be at least 11% of the volume of the blood in the source reservoir. The requirement, that in order to avoid contamination in an adjoining surface the diameter of the tube is at most 5 mm, does not apply for that length of the tube in which the neocytes are situated. In the event that the quantity of blood in the source reservoir is for example 500 ml, the tube can consist of a first piece with a length of 70 cm and a diameter of 1 cm. An advantage of such a division of the tube into two pieces is that it is not necessary to work with a long, and therefore difficult to handle, tube of 250 cm long.

It is observed that if the source material is bone marrow instead of blood, the volume of the tube must be at least 4% of the outgoing volume of the bone marrow for collecting and thereafter isolating the components of the buffy coat. The reason is that bone marrow contains relatively many more white blood cells. Less stringent requirements are made of the diameter of the tube. In the case of bone marrow this can therefore be for example 1 cm.

An alternative to a thin tube with a reel is a tube with bulges in the place where the respective platelets, white cells and neocytes collect. These bulges are divided by narrower parts of the tube and can be clamped off there.

In order to reduce the chance of contamination of the components with a relatively small volume, both by each other and of the platelets by blood plasma and of neocyte-rich by neocyte-poor blood, it is important to maximize the speed with which these components flow into the tube. In order to be able to complete the process of separation and isolation in as short a time as possible anyway it is advantageous, according to a further characteristic of the closed system according to the invention, to equip this with, or to have it work in combination with, means with which depending on the component which is leaving the source reservoir, the rate at which that component flows out of the reservoir can be regulated. Such a means can for example include a sensor, which depending on the component which it "sees passing" regulates the outflow rate.

A preferred design of the system according to the invention, if both neocytes and white blood cells and platelets must be isolated, is characterized in that the source reservoir is equipped with a preferably spherical body with a specific gravity which is smaller than that of the neocytes and larger than that of the white blood cells, and in that the outflow opening of the source reservoir to the tube has such a shape that the opening is partially closed off by the spherical shaped body when the body lies against it.

When the buffy-coat components and thereafter the neocytes have flowed into the tube, the small spherical body will partially close off the outflow opening so that the further inflow of the red cells into the tube will occur more slowly and the chance of mixing in the tube will be reduced.

In another preferred design the means is a sensor which is present in the device and which registers the flowing out of the first cells of a component and in combination therewith regulates the outflow rate.

The outflow rate can also be reduced during centrifuging if a source reservoir with a certain shape is applied. Such a source reservoir has at the end where it is connected with the outflow pipe a narrowing of such a shape that, when the blood platelets begin to flow into the outflow pipe during centrifuging, the outflow rate is reduced. The mass of red cells, white cells and blood platelets remaining in the source reservoir after the flowing out of the blood plasma has such a viscosity that, when this mass is forced to change shape, the rate of flow decreases at a certain quantity of supplied energy. By adjusting the shape of the narrowing to the said viscosity and to the quantity of the said cells the result can be achieved that at the moment upon which the blood platelets have reached the outflow opening the outflow rate begins to decrease. By a narrowing is meant in this connection: any shape of the source reservoir which leads to an increasing flow resistance when the relevant mass flows into the relevant part of the reservoir. For example, the outflow side of an otherwise cylindrical reservoir can have a conical shape. The angle of the walls is then chosen in such a way that the result is a desired reduction of the outflow rate.

For isolating the components which are present at any given time in the tube various methods can be applied. The tube can, for example, be divided into compartments with the aid of clamps which grip at the location of an adjoining surface between components, after which the contents of each compartment are pressed out into a chamber which is intended for that purpose.

In a preferred design according to the invention the compartment of the tube in which the neocytes are collected is connected in a closable manner with an auxiliary chamber, in which after the centrifuging process has been stopped the neocytes are collected. Such a chamber can also be used at the platelets compartment and at the compartment for the white blood cells.

For isolating the different components which are situated in a tube it is advantageous to use a plateau, or table, on which the filled tube, with the auxiliary chamber(s) which may be coupled thereto, can be fixed after this has been unrolled. Such a plateau is equipped with clamps which can be slid over a rail running alongside the tube which is fixed onto the plateau. These clamps can be clamped onto the tube at the location where a dividing surface between two components is situated in the tube, so that the already mentioned compartments are formed.

The invention will be further explained with the aid of the drawings, which schematically show embodiments of a device according to the invention, and in which situations are shown which occur during execution of the method.

DETAILED DESCRIPTION

Figure 1:
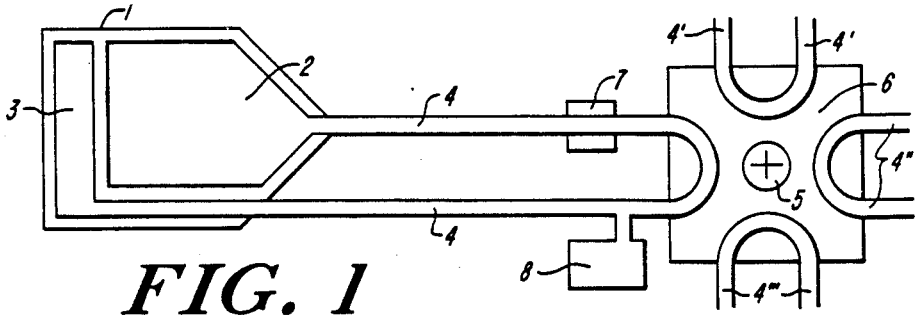
FIG. 1 is a view from above of a horizontal cross section through a device illustrative of one aspect of the invention.

In FIG. 1 the container 1 contains a source reservoir 2 and a recipient reservoir 3, both made of flexible material, for example as plastic disposables, joined to each other by a pipe 4. The pipe 4 runs via a pump 6 which is mounted above the centrifuge shaft 5. In FIG. 1 a centrifuge with four "arms" is shown. The drawn pipes 4', 4'' and 4''' correspond to arms other than the drawn arm.

The pipe 4 is equipped with a valve or closure 7, with which the pipe can be closed off when a certain component has passed out of the mixture. The closure 7 reacts on a signal from an "eye" which may, for example, be a light source and photodetector arranged about the pipe and which detects the passage of a dividing layer between the components.

An extra reservoir 8 is coupled with the pipe 4, filled with a physiological salt solution. When a vacuum begins to form in the system at a certain rotational speed, this solution will be sucked into the system. When the source reservoir 2 and recipient reservoir 3, partially as a result of the extra liquid which is brought to the system out of reservoir 8, "fill" the container, a pressure will be built up in the system such that the undesired vacuum will be compensated for.

Figure 2:
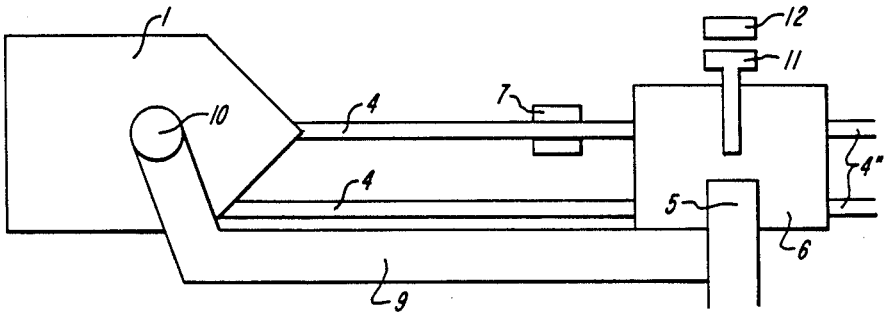
FIG. 2 is a side view of the device of FIG. 1.

FIG. 2 shows the same device in a side view. With 9 is given the arm of the centrifuge on the end of which the container, hinging around an axle 10, is mounted. With 11 is meant the drive shaft of the pump, which is mechanically coupled with the pump housing 6 and thereby with the centrifuge shaft 5. This drive shaft 11 can be be disengaged during centrifuging with the aid of a pressure piece 12.

Figure 3:
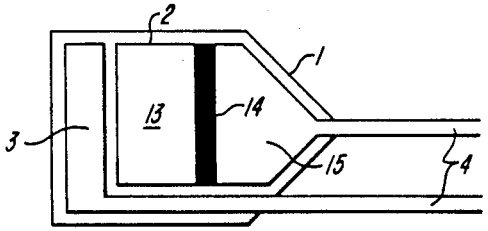
FIG. 3 shows in detail the situation in the container after centrifuging for some time, and before pumping begins.

FIG. 3 shows the situation in the container 1 after blood has been centrifuged for some time. The blood is separated into red blood cells 13, blood plasma 15 and therebetween, in a layer 14, the so called "buffy coat", consisting of blood platelets and white blood cells.

Figure 4:
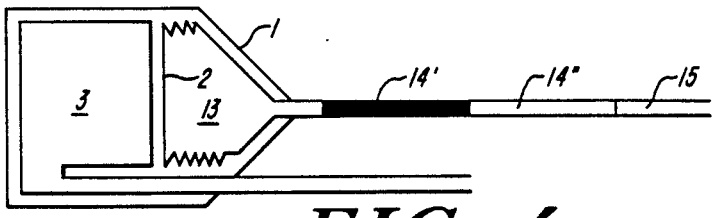
FIG. 4 shows the situation during pumping.

FIG. 4 shows the situation after pumping has taken place for some time after centrifuging. The plasma 15 leaves the source reservoir 1 as the first component and comes into the recipient reservoir 3. Next comes the buffy-coat. By stopping the pumping when the buffy coat is situated in the narrow pipe 4, and thus forms a relatively thick layer, it becomes possible to effect a separation between blood platelets 14'' and the rest of the white blood cells 14'.

Figure 5:
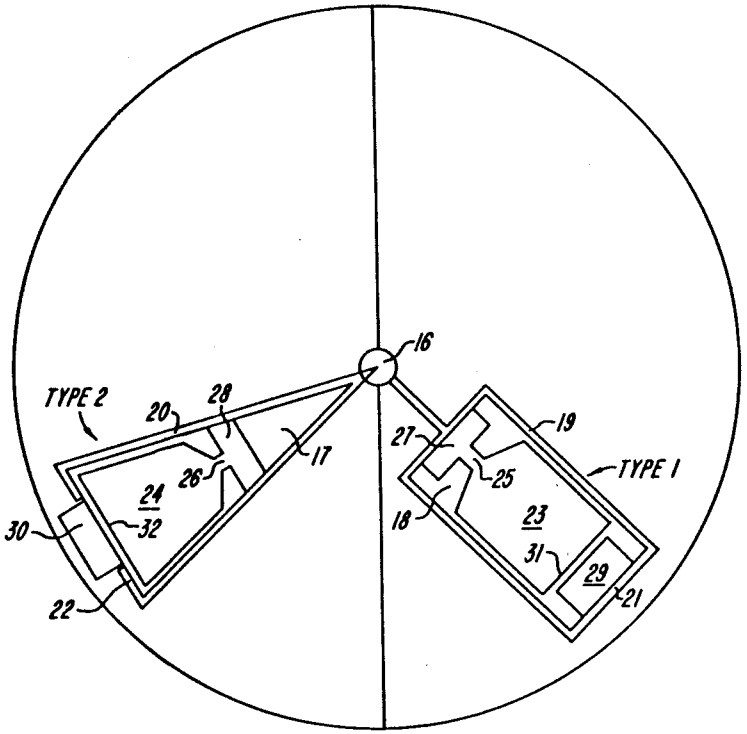
FIG. 5, viewed from above and perpendicular to the centrifugal axis, is a cross section through a centrifuge, in which two different design examples of centrifugal units are schematically drawn.

In FIG. 5, 16 is the centrifuge shaft, to which centrifuge units 17 and 18 are attached. One centrifuge contains in general one type of centrifuge unit, therefore, for example, either all units of type 1 or of type 2. For purposes of this discussion, "type 1" refers to the design of unit 18, and "type 2" refers to the design of unit 17. The centrifuge units 17 and 18 each consist of containers 19 respectively 20, with radially outer walls 21, respectively 22. In the containers 19 respectively 20 are flexible, for example plastic, source reservoirs 23 respectively 24 for the blood which is to be centrifuged. The walls of the containers 23 and 24 converge at the radial inner end in a funnel shape to the outflow openings 25 respectively 26. The outflow openings 25 respectively 26 open out into recipient reservoirs 27 respectively 28, of which a part is drawn. In order to guarantee the sterility of the contents, the source reservoir and the recipient reservoir in each unit are connected to each other via an outflow tube. With 29 and 30 the elevations are given, which move inwards, that is to say in the direction of the centrifugal axis, in relation to the respective outside walls 31 and 32 during the pumping out. The elevation 29 illustrated in the type 1 is permanently connected with the outside wall 21 of the container. During the pumping out, the reservoir 23, which is situated in a housing which moves together with reservoir (not drawn), moves outwardly and will extend over each side of the elevation 29. In the type 2 the elevation 30 is situated outside the outer wall 22 of the container 20. This outer wall 22 is equipped with a hole, through which the elevation 30 can be moved in the direction of the centrifugal axis 16, thereby pushing in the outer end of the reservoir 24. The means by which the elevation 30 can be moved inward are not drawn. This can be done, for example, hydraulically. The different ways of pumping out: either by pressing the elevation into the outer end of the reservoir, or by pressing the reservoir against the elevation can both be applied to either of the container types.

With the use of centrifugal unit of type 1 the space available in the centrifuge can be used better than with use of units of the type 2. With type 1, 12 standard units for example can be placed in one circular disk.

Figure 6:
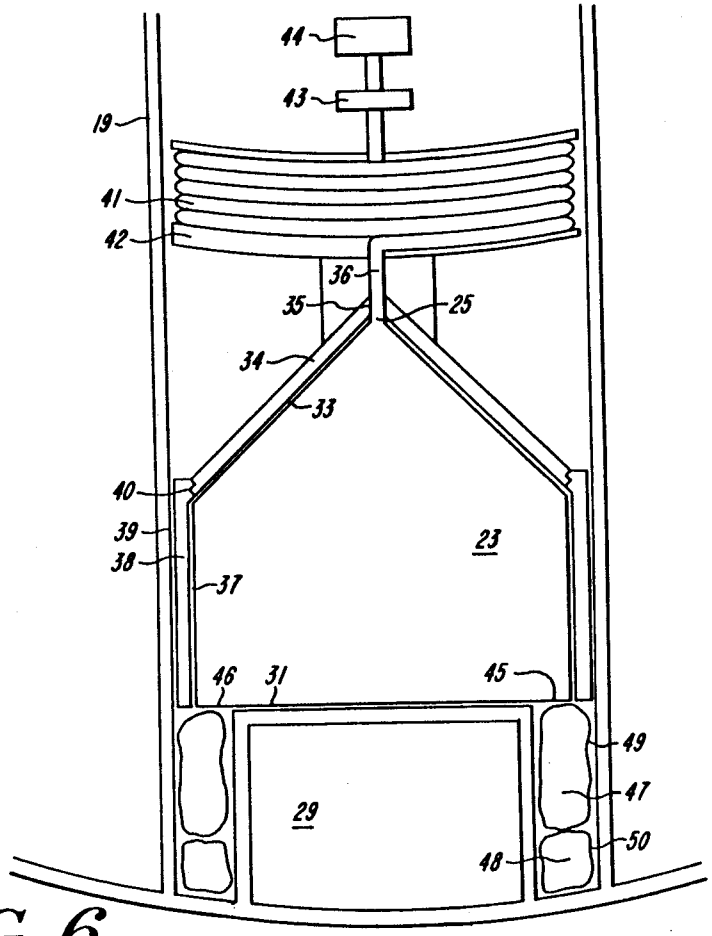
FIG. 6 shows in more detail the same cross section of one of the centrifugal units shown in FIG. 5.

In FIG. 6 a same cross section as in FIG. 5 is shown in detail of a design of a centrifugal unit of type 2. The source reservoir 23 shows a wall section 33 converging at the inner end in a funnel shape. This wall section is held in shape by the cap 34 which lies over it. This cap 34 is equipped at its inner end with a hole 35 which when in use lies over the outflow opening 25, so that the outflow pipe 36 can pass through it. In order to be able to place the cap 34 onto a source reservoir 23 the jacket thereof must contain an opening (not drawn) extending from the hole 35 outwardly.

The source reservoir 23 is supported on its side walls 37 over preferably the whole height thereof by a housing 38, which can slide from the inside outwardly along the inner wall 39 of the container 19. In the drawn example, cap 34 and housing 38 are connected to each other by a screw closure 40.

The recipient reservoir consists of a tube 41, which is connected at one end to the outflow opening 25 of the reservoir 23, is wound around a spool or reel 42 which is mounted on the cap 34, and at its other end to one or more collecting chambers (not drawn) for the components. At the recipient reservoir are included a sensor 43, which detects when a following component "passes", and a valve or closure, 44.

In order to be able to divide the blood in the source reservoir 23 into its components, it is first centrifuged, without the liquid being pumped out of the reservoir, while the closure 44 is closed. When the separation is completed, the closure 44 is opened. Due to the centrifugal force the reservoir 23 will then move outwardly, sliding with its housing 38 along the inside wall 39 of the container 19. The flexible outer wall of the reservoir is then dented in by the elevation 29 and at places 45 and 46 extends over the sides of that elevation in a ring shape and the fluid is pressed out of the reservoir 23. After the first component—the blood plasma—is thus pumped out, it is the turn for the buffy cont. As this has been pressed inwardly during the pumping out of the plasma, this will eventually be situated in the inmost tip of the funnel. Due to the funnel shape a reduction of the surface, and therefore an increase of the thickness of that layer has come about. Nevertheless, in order to avoid that fluid of the following component also comes out when pumping, the pumping rate must be relatively low; lower than is required when pumping out the plasma.

In order to be able to regulate that rate, two inflatable rings 47 and 48 with valves 49 and 50 are situated behind each other around the elevation 29. The rings 47 and 48 and the width of the valves 49 and 50 can be given such dimensions, that as long as plasma is being pumped out, ring 47 deflates at a relatively high speed, and that when it is the turn for the buffy-coat ring 48 deflates with a lower speed.

Figure 7:
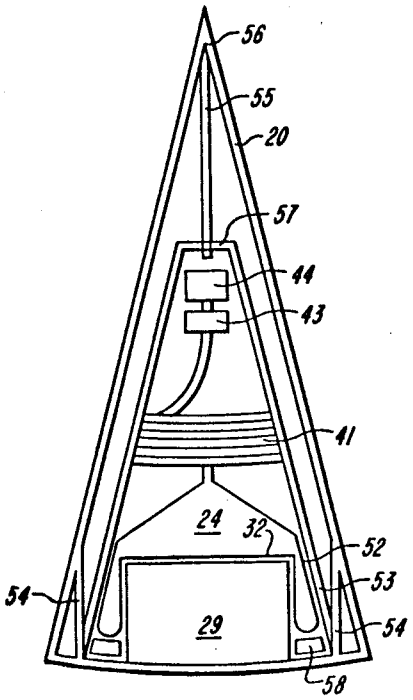
FIG. 7 shows a similar detailed cross section through the other centrifugal unit drawn in FIG. 5, in which however the pump mechanism is another than that shown in FIG. 5.

FIG. 7 shows the cross section of centrifugal unit 17 according to FIG. 5 in more detail, with the difference that the relative movement of the outside wall 32 in relation to the elevation 29 is now achieved by pressing the source reservoir 24 outwards against the elevation 29 instead of the other way around. An advantage of the reservoir shape according to FIG. 7 is the already mentioned better degree of filling of the centrifuge. In order to still be able to pump out with the aid of the centrifugal force alone—therefore by being able to allow the source reservoir to move outwards—some special facilities are necessary. In the container with converging walls 20 in order to make maximum use of the space available, there is also a reservoir 24 with converging walls 52 which are laterally supported by a converging housing 53. This housing lies, in the starting position, with its walls against the walls of the container 20. When this housing 53 begins to move under influence of the centrifugal force it must be guided. For that purpose the guides 54 are mounted in the container 20, preferably also in the shape of a cartridge shaped body, along which the wall of the housing 53 slides. The housing is further guided in radial direction by a rod 55 fixed at the front at 56 to the container 20 and at the other end fixed in a sliding manner to the inward wall 57 of the housing 53, through which it protrudes.

With 58 the inflatable rings are schematically given, corresponding with the rings 47 and 48 drawn in FIG. 6.

Elements 43 and 44 are the already mentioned sensor and the closure valve, respectively, in the recipient reservoir, of which the tube 41 is drawn, wound on a reel which is not drawn.

In FIG. 7 a situation is drawn in which the housing is situated in the most outward position.

Figure 8:
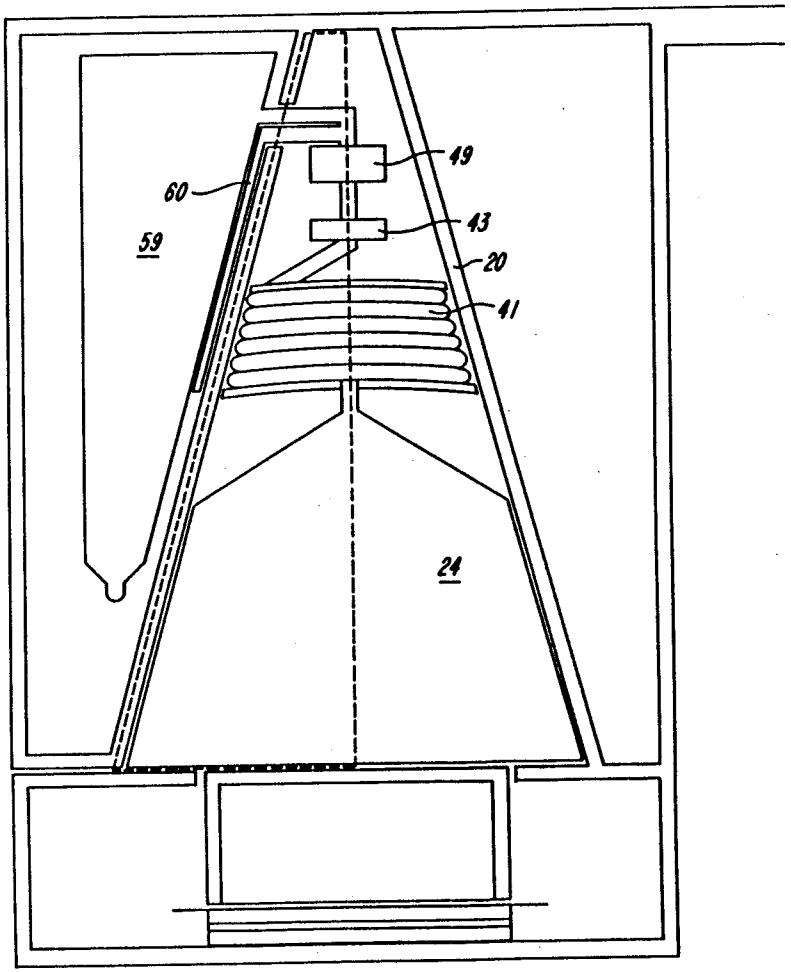
FIG. 8 shows a cross section through a conical centrifugal unit according to FIG. 7, through the middle of the unit, but now parallel to the centrifugal axis.

FIG. 8 is a vertical cross section, parallel to the centrifugal axis through a centrifugal unit as drawn in FIG. 7, but then conically shaped. An advantage of the conical shape is that the collecting chambers of the recipient reservoir, seen in the direction of the centrifugal axis 5, can lie over the container, whereby a maximum amount of space is available for the reservoirs with the blood which is to be centrifuged. The collecting chambers 59 for the plasma and a second collecting chamber 60 for the blood platelets are drawn.

Figure 9:
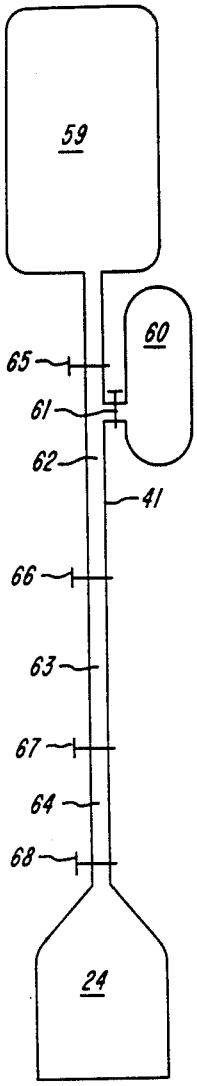
FIG. 9 schematically shows the closed system of source and recipient reservoirs.

The isolation of the plasma and the platelets in the receiving chambers is explained further with the aid of FIG. 9 giving schematically the closed system of the source reservoir 24 and the recipient reservoir, consisting of the tube 41, the collecting chamber 59 for the plasma and the auxiliary chamber 60 for isolating the blood platelets. When blood is present in reservoir 24, this reservoir is closed off with a snap connection 68. The system is then placed in the centrifuge. Then the snap connection 68 is broken and closure 44 (see FIG. 8) takes over the closing function. The centrifuging now takes place, and after the buffy-coat is formed the closure 44 opens. Now plasma and buffy-coat can be isolated as described. When the platelets pass the sensor 43 closure 44 closes again. When this has been done for the last centrifugal unit the centrifuge is stopped. The system is then removed from the centrifuge and the tube 41 is unrolled. The tube 41 is divided into compartments corresponding to the presence of the different components by placing clamps 65, 66, 67 and 68 at the boundaries of the components. By opening snap connection 61, which closes the auxiliary chamber 60 off from tube 41, the component 62 for example (the platelets) can be pressed into auxiliary chamber 60.

In order to ensure that the platelets, the white cells and the neocytes are and remain separated from each other in the tube 41 it is necessary that during centrifuging the g-value which works on the fluids decreases continually and evenly from the entrance to the exit of the tube. For this purpose the tube should be stored in a special way radially inward from the outflow opening. A reel around which the tube is wound in adjacent windings must have a special shape for this purpose.

Figure 10:
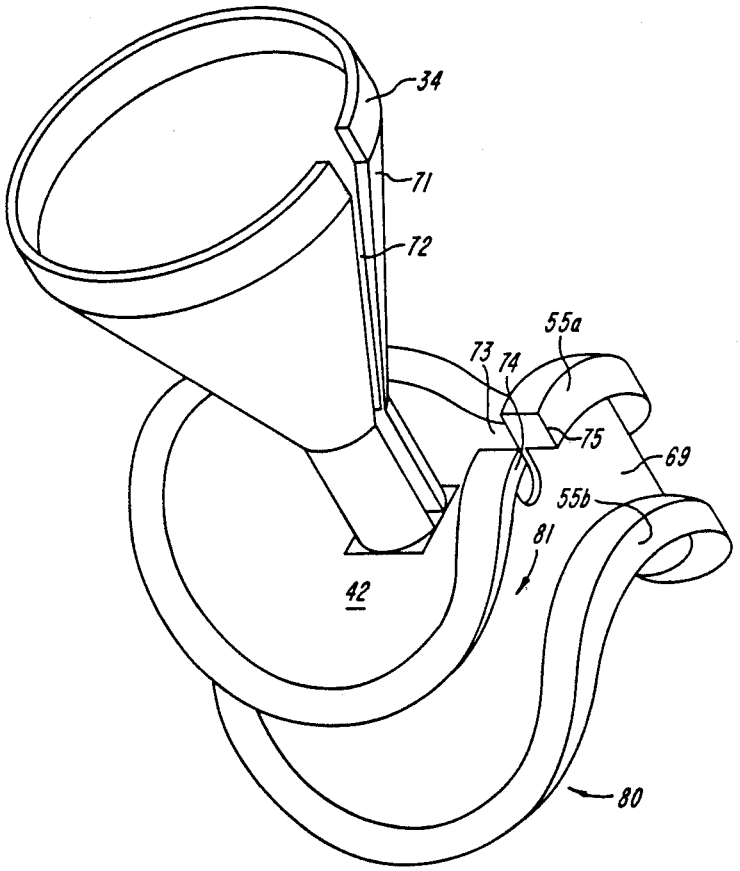
FIG. 10 shows a reel in perspective for winding up the tube section of the recipient reservoir, whereby the reel forms a whole with a cap which is placed over the radially inward end of the source reservoir.

FIG. 10 shows in perspective how one reel 42, in the drawn position permanently joined to a cap 34, should look in order to comply with the aforegoing requirements with regard to the g-value. The tube 41 is regularly wound around the reel part 69 from the cap 34, lying between the standing edges 55*a* and 55*b*.

In FIG. 10 is also shown how in the jacket 71 of a cap 34 the opening 72 is placed which makes it possible to place the cap on a source reservoir 24. In order to obtain a correct winding, the reel is constructed in such a way for example that the thickness 74 of the edge 55*a* continually increases in the direction of winding from the place 73, where the tube 41 enters the reel, so that this has increased after one winding by the diameter of the tube to thickness 75.

In FIG. 10 reel 42 is drawn with a reel-axis 80, and is connected to a conical cap 34, which when in use falls over the inward face of the source reservoir. The—not drawn—flexible tube which is connected to the outflow opening of the source reservoir is wound in adjacent windings around the reel surface 69, which is limited by the standing edges 55*a* and 55*b*. The tube enters the reel via the opening 73. The thickness 74 of the edge 55*a* increases continually from the opening 73 in the direction of winding 81 to a thickness 75 whereby the difference between the thickness 74 and 75 corresponds with the diameter of the tube used. If, when winding on the tube, it is laid against the edge 55*a* and following windings are always laid against the previous windings, a spiral shaped winding of the tube on the reel surface 69 is achieved in a simple manner, whereby the g-value in the tube continually decreases. The shape of the reel surface 69, which has a circular cross section perpendicular to the reel axis 80, is determined by the condition, that the distance of the tube to the centrifugal axis, which when in use stands perpendicular to the reel axis 80, continually decreases from the beginning up to the end of the tube.

Figure 11:
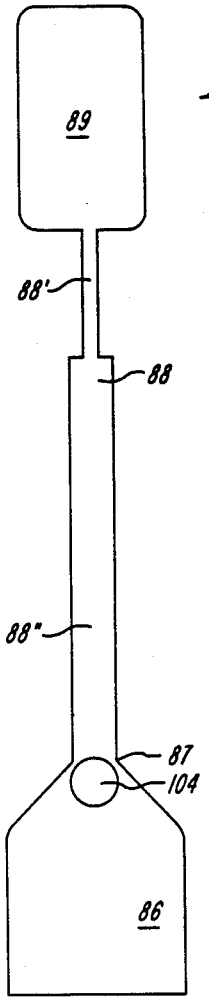
FIG. 11 shows schematically a closed system according to the invention, in which the tube consists of two parts of differing thickness and in which the source reservoir contains a spherical body.

In FIG. 11 the closed system according to the invention is shown schematically, as that is used for blood as a source material. Before centrifuging, the blood which is to be separated is situated in source reservoir 86. After the desired separation has been brought about in this reservoir by centrifuging, the contents of the reservoir are pumped out of the reservoir via the outflow opening 87. First the blood plasma comes out and flows through the flexible tube 88 to the recipient reservoir 89. The tube 88 consists of a first part 88' with a maximum inner diameter of 5 mm and of which the contents preferably amount to at least 1% of the total volume of the source material, and a second part 88'', of which the inner diameter is for example 1 cm and whose contents are preferably at least approximately 10% of the total volume of the source material. The buffy-coat is collected in the tube part 88' and the neocytes in the tube part 88''.

The precise volumes of tube segments 88', 88'' are such that for the standard source blood bag 86, the segments 88', 88'' will hold all of the platelet (respectively neocyte) fraction likely to occur in the blood of a normal individual.

Referring to the spatial location radially outward from the centrifuge axis as "upstream," it will be seen that the larger diameter tube segment 88'' is supported upstream of the smaller diameter portion 88' during the centrifuging operation.

A small spherical body is indicated with 104 with a specific gravity which is smaller than that of the neocytes and larger than that of the white blood cells. This small spherical body 104 partially closes off the outflow opening when the last white blood cells have passed the outflow opening 87 during the pumping out. The outflow speed is thereby decreased, so that contamination to the surfaces of the adjoining buffy-coat components is prevented.

When one or more tube segments supported to provide a centrifugal gradient for effecting or maintaining separation of fractional components are removed from the centrifuge apparatus, the final isolation of the separated components is easily effected by unreeling the tube on a flat table or plateau. The boundaries between adjacent fractions in the tube are then visually ascertained, and by providing pinch-off clamps at appropriate sites, each faction is isolated. The isolated factions are preferably then each expressed into a separate chamber. Such a preferred arrangement is shown schematically in FIG. 12.

Figure 12:
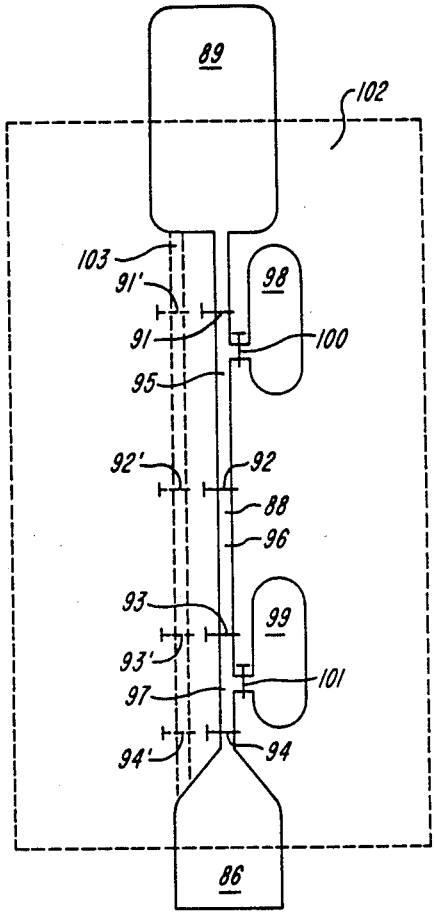
FIG. 12 shows also schematically a closed system according to the invention, whereby parts of the tube are equipped with closable auxiliary chambers and the whole is fixed onto a plateau equipped with a rail with clamps.

In FIG. 12 the closed system according to FIG. 11 is shown again with the source reservoir 86, the flexible tube 88 and the recipient reservoir 89. In this design the flexible tube 88 has one uniform diameter. When after pumping for a certain time the components—the blood platelets, the white blood cells and the neocytes—are situated in the tube separated from each other, the isolation must still take place. This can be achieved by dividing the tube into compartments 95, 96 and 97, corresponding with the different components, with the aid of clamps 91, 92, 93 and 94. The contents of each compartment are then collected in for example auxilliary chambers 98, 99, of which two are drawn, which are connected with the appurtenant compartments via snap connection 100, 101.

In order to be able to easily isolate the components which are present in the tube and divided from each other, this can be fixed in an unrolled position onto a plateau 102, which is equipped with a rail 103, along which clamps 91', 92', 93' and 94' can be moved. These clamps can then be clamped on to the tube at the place where a dividing surface between components is situated in the tube 88, thereby forming the said compartments 95, 96 and 97. The contents thereof can thereafter be pressed into the auxiliary chambers 98 and 99.

If use is made of a tube with bulges instead of a thin tube with a reel, the compartments 95, 96 and 97 correspond with these bulges. The dimensions for the bulges could be: for the platelets 2 cm (inner diameter 1.5 cm), for the white cells 3 cm (inner diameter 1.5 cm), and for the neocytes 4 cm (inner diameter 4 cm). A plateau along which the clamps are moved is not necessary in this case because clamping off always takes place at the pieces of the tube (1 cm long) which are situated between the bulges.

In either case, it will be appreciated that the source reservoir, the tube, and any bulges or auxiliary chambers are formed as a closed sterile system, in which, initially the tube and chambers not actively utilized in a processing step are closed off fro the active components. Thus, for example, a snap-connection will isolate the tube 88 from the source reservoir 86, into which blood is initially drawn from a blood donor. When placed in the centrifuge for separation, the snap-connection is broken, allowing flow of the separated plasma through tube 88 into plasma-receiving reservoir 89. When the separated white cells, platelets and possibly neocytes have been stopped along the length of tube 88, additional snap-connections isolating the auxiliary chambers 98, 99 may be broken and the separated components expressed into those chambers, which are then closed, e.g., by heat-sealing, in a manner known in the art. Thus the entire process of drawing blood, separating, and isolating the fine components thereof is effected in a closed sterile environment. This prolongs the life of the separated buffy coat components over that obtained by previous multi-process methods of isolation.

It will be appreciated that the invention has been described with respect to particular embodiments thereof, and that such description is by way of illustration, and the invention is not limited thereto. The invention being thus disclosed, various modifications will occur to those skilled in the art, and such modifications are included within the spirit and scope of the invention, as defined by the following claims.

What is claimed is:

1. A method for separating in a centrifuge one or more fractional components of a biological mixture such as blood, such components having a volume of not greater than approximately 10% of the mixture, such method comprising the steps of centrifuging the biological mixture in a source reservoir at a speed and for a time to effect separation of the desired components into layers, maintaining a pressure in the source reservoir for flowing the components therefrom, and while still centrifuging and maintaining said pressure, pumping a separated component into a conduit oriented to have a sufficient centrifugal gradient along its length to maintain separation of the component in the conduit.

2. The method of claim 1, wherein the conduit has a volume sufficient to receive the said separated component therein, and the step of pumping further includes the steps of controlling flow from the source reservoir to cause the separated component to reside in the conduit, and when the component resides in the conduit, stopping the centrifuge.

3. The method of claim 2, wherein the conduit is a flexible tube having a length oriented against a centrifugal gradient by winding it about a spool, the spool having a radially-oriented axis.

4. The method of claim 3 wherein the step of pumping a component is carried out by providing a funnel-shaped cap over an outlet of the said source reservoir for converting the flow of a separated layer of a component from the source reservoir to a columnar body in said conduit.

5. The method of claim 3, wherein the conduit has a volume selected to be large enough to substantially entirely contain therein a desired fractional component, and a diameter small enough to prevent re-mixing when the centrifuge is stopped.

6. The method of claim 5, wherein the conduit comprises plural sequential segments, each said segment having a volume sufficient to receive a different said separated component therein.

7. The method of claim 1, wherein the source reservoir has a flexible outside wall, and the step of maintaining a positive fluid pressure includes the step of exerting a pressure on the flexible wall by pressure of an elevation against the wall.

8. The method of claim 7, wherein the pressure is exerted by the centrifugal pressure of the source reservoir against the elevation, and wherein the method further includes the step of providing a fluid-deflatable support adjacent to the elevation and in contact with the flexible wall, and controlling relative motion of the reservoir and the elevation by controlled deflation of the support.

9. The method of claim 7, including the step of supporting the source reservoir in an inflexible housing, and wherein the step of exerting pressure is accomplished by moving the elevation into the housing against the flexible wall of the reservoir.

10. The method of claim 1, wherein the step of maintaining pressure is accomplished by maintaining the fluid system comprising the source reservoir and conduit in a confined volume, and providing a reservoir of make-up fluid in pressure communicating relationship with said fluid system.

11. A set for use in a centrifuge for separating fractional components of a specimen fluid mixture such as blood, wherein the set comprises a flexible source reservoir having an outlet, at least one receiving reservoir, a conduit connected to the outlet and to the at least one receiving reservoir whereby to define together with the source and receiving reservoir a closed fluid system for transferring fluid from the source reservoir, and support means for supporting the conduit in the centrifuge in an orientation effective to maintain a sufficient centrifugal gradient along the conduit to inhibit mixing of separated fractional components therein during said transferring.

12. A set according to claim 11, wherein the support means further includes cap means for channeling a layer of the specimen fluid from the source reservoir proximate to the outlet thereof into the conduit.

13. A set according to claim 12, wherein the cap means is funnel-shaped.

14. A set according to claim 13, wherein the cap has a slot extending along its length for passage of the conduit therethrough, whereby the cap may be fitted over the source reservoir without disconnecting the conduit from the outlet.

15. A set according to claim 13, wherein the support means is removably affixed to the cap means.

16. A set according to claim 13, further including means responsive to the presence of desired fractional component at the outlet of the source reservoir for restricting flow therefrom so as to control the transferring of said component in the conduit.

17. A set according to claim 16, wherein the means responsive includes a float valve of a size to partially occlude the outlet, said float valve having a specific gravity intermediate that of the desired fractional component and an adjacent fractional component.

18. A set according to claim 16, wherein the means responsive includes a narrowing in the region of the outlet, such narrowing being of a shape adjusted to the viscosity of the fractional components such that the flow through the outlet diminishes to a desired rate when the desired fractional component enters the region of the outlet.

19. A set according to claim 11, wherein the support means includes a spool surface for winding the conduit thereon.

20. A set according to claim 19, wherein the source reservoir has a characteristic volume of a said fractional component, and the conduit is of a dimension to substantially contain said characteristic volume, whereby said conduit is a receiving reservoir for said component.

21. A set according to claim 20, wherein the source reservoir includes flow control means, for controlling the rate of flow of the said fractional component in the conduit.

22. Apparatus for the centrifugal separation of fractional components of a specimen liquid mixture such as blood, by centrifuging the liquid in a flexible source reservoir so as to separate the fractional components radially with respect to a centrifuge axis, and, while centrifuging, transferring a separated fractional component thereof from the source reservoir, wherein the apparatus includes a conduit connected to the source reservoir for effecting said transferring, said conduit being oriented so as to have along its length a directional component radially directed toward the axis so as to maintain therein during said centrifuging a sufficient centrifugal gradient for inhibiting mixing of the separated fractional components therein during said transferring.

23. Apparatus according to claim 22, wherein the conduit is a flexible tube, and the apparatus further includes a support member for supporting the tube so as to have said directional component radially directed toward the axis.

24. Apparatus according to claim 23, further including at least one receiving reservoir, wherein the conduit is connected as an inlet to each said at least one receiving reservoir at portions thereof spaced along its length.

25. Apparatus according to claim 24, further including means spaced along the conduit for isolating the separated, transferred components.

26. Apparatus according to claim 25, wherein a reservoir is a segment of the tube.

27. Apparatus according to claim 26, wherein the means for isolating includes the inner wall of a tube segment, such wall having a diameter selected to be sufficiently small to inhibit mixing of the separated components contained along the tube therebetween in the absence of a centrifugal gradient, thereby isolating the said separated components.

28. Apparatus according to claim 25, wherein the means for isolating includes a valve for closing-off fluid communication to each said receiving reservoir.

29. Apparatus for the isolation of fluid components contained in sequential segments of a tube, such apparatus comprising:

a plateau for supporting the tube in a linear fashion next to a rail, a rail, mounted on the plateau, and having a plurality of clamp members movably attached thereto, such that each said clamp may be positioned at a variable spacing from other clamp members between each said sequential segment of the rube for isolating the fluid component in the said segment.

30. Apparatus according to claim 29, wherein a said clamp is a roller clamp, for expressing fluid from the tube by rolling the clamp over the tube.

31. A centrifuge for the separation of fractional components of a specimen liquid mixture such as blood by centrifuging the liquid in a source reservoir so as to separate the fractional components into radial layers, and while centrifuging transferring a fractional component thereof via a conduit to a receiving reservoir, said conduit, source reservoir and receiving reservoir forming a closed fluid system, said source reservoir being located at least in part radially outward from said receiving reservoir, the apparatus including a blocking member for blocking flow from the source reservoir through the conduit, wherein the apparatus further comprises:

means for controlling the blocking member to permit or block flow, an orifice defining a portion of a flow path from the source reservoir to the conduit, and a restriction member responsive to the presence of a desired fractional component at the orifice, to partially block the orifice, thereby diminishing the rate of flow from the source reservoir.

32. Apparatus according to claim 31, wherein the restriction member is a float body, having a specific gravity between that of the said fractional component and an adjacent component, and having a shape adapted to partially block the orifice.

33. Apparatus according to claim 32, wherein the float body has a specific gravity lying between the specific gravities of platelets and neocytes.

34. Centrifugal apparatus for separating fractional components of a specimen fluid mixture such as blood, and including a flexible source reservoir having an outlet, at least one receiving reservoir, and means for rotating the source and the at least one receiving reservoir about an axis at a speed sufficient to effect the separation of the fractional component, such apparatus further including a conduit extending from the outlet to the at least one receiving reservoir whereby to define a closed fluid system, said conduit having an orientation effective to establish a centrifugal gradient when the centrifuge rotates to prevent mixing of separated blood components in the conduit, a reservoir of make-up fluid, and means for flowing the make-up fluid under pressure into fluid pressure communication with the fluid system for maintaining the fluid system in a pressurized condition thereby preventing the formation of an under pressure condition in the conduit.

35. Apparatus according to claim 34, wherein the make-up fluid has a density greater than that of a fractional component of the specimen mixture and wherein the reservoir of make-up fluid is located radially inward toward the axis from the source reservoir, and wherein the means for flowing the make-up fluid under pressure includes a valve between the make-up fluid reservoir and the fluid system, and means for opening the valve whereby the make-up fluid flows by centrifugal force into fluid pressure communication for maintaining said pressurized condition.

36. Apparatus according to claim 35, wherein the make-up fluid is a saline solution and the valve permits the make-up fluid to flow into the source reservoir.

37. A set for use in a centrifugal apparatus in the separation of a desired fractional component of a fluid mixture such as blood, and comprising a source reservoir and a conduit connected thereto for transferring fluid from the source reservoir, the desired fractional component occurring in a characteristic volume in the said source reservoir, wherein the conduit is a tube having an interior volume at least equal to said characteristic volume, whereby by orienting the tube against a centrifugal gradient during centrifuging the desired fractional component may be transferred into the tube and entirely contained therein without mixing of the separated component.

38. A set according to claim 37, wherein the diameter of the tube is sufficiently small to prevent mixing of the separated desired fractional component therein even in the absence of a centrifugal gradient in the tube.

39. A set according to claim 38, wherein the diameter is less than approximately 5 mm.

40. A set according to claim 37, wherein the tube is connected to the source reservoir at an outflow opening thereof, and wherein the tube comprises a first segment proximal to the outflow opening having a volume at least equal to the characteristic volume of a first desired component, and a second segment distal to the outflow opening having a volume at least equal to the characteristic volume of a second desired component, said first and second segments having different diameters.

41. A set according to claim 40, wherein the first and second desired components are neocytes and platelets, respectively, and wherein the diameter of the second segment is less than approximately 5 mm.

42. A set according to claim 37, wherein the desired component has a characteristic volume of less than approximately 1% the volume of the source reservoir.

43. A set according to claim 37, further comprising at least one auxiliary chamber communicating with said conduit at a position between ends of the conduit for receiving the fractional component from the conduit.

44. A set according to claim 37, wherein a said auxiliary chamber communicates with said conduit via a snap connection which may be broken to allow fluid from the conduit to enter the auxiliary chamber.

45. A set according to claim 37, wherein said conduit includes a portion of enlarged diameter for receiving a said fractional component therein.

46. A set according to claim 45, wherein a said portion of enlarged diameter is a bulge having a size to receive a said fractional component.

47. A support member for supporting a flexible blood receiving set in a centrifuge, such member including:

a support surface for winding a conduit thereon in an orientation so as to have along the length of the conduit a sufficient component along the centrifugal gradient of the centrifuge to maintain separation of blood components in the conduit, and means defining the location of said unwinding so as to achieve the said orientation of the conduit on the support surface.

48. A support member according to claim 47, wherein the means defining the location of the winding includes an edge flange defining a generally saddle-shaped winding of the conduit about the spool surface.

49. A support member according to claim 48, further including a funnel-shaped cap for fitting over and supporting a flexible source reservoir in defined geometrical relationship to the spool surface.

50. A support member according to claim 49, wherein the cap is slotted for passage of the conduit therethrough when fitting the cap over the source reservoir, whereby the support member may be fitted over a conduit and reservoir of one-piece construction.

* * * * *